United States Patent [19]

Litner

[11] Patent Number: 4,546,850

[45] Date of Patent: Oct. 15, 1985

[54] SPEAKER AND GRILLE INSTALLATION CLIP MOUNTING

[75] Inventor: Richard C. Litner, Milford, Mich.

[73] Assignee: Chrysler Corporation, Highland Park, Mich.

[21] Appl. No.: 588,475

[22] Filed: Mar. 12, 1984

[51] Int. Cl.[4] ..... H04R 1/02

[52] U.S. Cl. ..... 181/141; 181/150; 248/634; 248/27.3; 381/86; 179/146 R; 179/179

[58] Field of Search ..... 248/634, 27.1, 27.3; 179/115.5 R, 146 R, 178, 179; 181/150, 171, 199, 141; 73/431; 220/3.5, 3.6; 455/350; 381/86

[56] References Cited

U.S. PATENT DOCUMENTS

| | | | |
|---|---|---|---|
| 1,398,373 | 11/1921 | Graesser | 248/27.3 |
| 1,877,085 | 9/1932 | Trefry | 181/171 |
| 2,485,406 | 10/1949 | Paine . | |
| 2,496,938 | 2/1950 | Friedman | 248/27.3 |
| 2,762,989 | 9/1956 | Johnson | 248/27.3 |
| 3,678,261 | 7/1972 | McNeil | 248/27.3 |
| 3,799,483 | 3/1974 | Chiappinelli | 248/27.3 |
| 4,032,725 | 6/1977 | McGee | 248/27.1 |
| 4,039,131 | 8/1977 | Perrault . | |
| 4,056,165 | 11/1977 | Okamoto | 381/86 |
| 4,281,224 | 7/1981 | Castagna | 179/178 |

FOREIGN PATENT DOCUMENTS

| | | | |
|---|---|---|---|
| 2538083 | 3/1977 | Fed. Rep. of Germany | 248/27.3 |
| 954943 | 6/1949 | France | 248/27.3 |
| 45-27490 | 9/1970 | Japan | 248/27.3 |
| 541793 | 12/1941 | United Kingdom | 248/27.3 |
| 980336 | 1/1965 | United Kingdom | 248/634 |

OTHER PUBLICATIONS

Moore, William, "RCA Technical Notes–Loud Speaker Retainer", Dec. 1964.

*Primary Examiner*—J. Franklin Foss
*Assistant Examiner*—Robert A. Olson
*Attorney, Agent, or Firm*—Edward P. Barthel

[57] ABSTRACT

A speaker and grille assembly clip mounting for use in installing the assembly into a vehicle panel opening. A pair of generally Z-shaped clips are in opposed alignment on the speaker. Each clip has an outwardly diverging shoulder portion deformably joined to an inwardly converging arm portion defining a downwardly extending included obtuse angle spring. Each arm portion terminates in a return bend finger portion which is biased into sliding contact with the speaker magnet. The shoulder and arm portions are resiliently collapsible away from each other to permit ready passage of the clip portions past the panel opening during installation and removal. In position each clip shoulder portion is spring biased into engagement with the opening providing a vibration and shock absorbing speaker and grille snap-in mount.

2 Claims, 5 Drawing Figures

SPEAKER AND GRILLE INSTALLATION CLIP MOUNTING

BACKGROUND OF THE PRESENT INVENTION

This invention relates to vehicle speaker and grille assemblies and more particularly pertains to spring clip retainers removably mounting a speaker and grille assembly in a panel opening of a vehicle body.

Various shock mounted speaker and grille assemblies are complicated and costly structures. For example in the Okamoto et al U.S. Pat. No. 4,056,165 a bolted fixture is required. Such construction also has the disadvantage that it is not readily adaptable to different sized openings and requires installation tools, such as a screwdriver. The U.S. Pat. No. 3,799,483 to Chiappinelli disclose a mounting collar for an automobile radio having releasable locking means. In the Chiappinelli patent resilient clips are formed with locking grooves that receive and resiliently retain corresponding locking lips of a mounting collar.

SUMMARY OF THE INVENTION

It is the primary object of the present invention to provide a readily installed removable speaker and grille mounting assembly requiring no attaching tools while insuring a shock and vibration free installation.

The speaker and grille mounting, according to the present invention, fits into a predetermined sized opening without the need of special locking collars or separate fasteners. The mounting uses spring clips each having shoulder and arm portions defining an obtuse included angle. The free end of the arm portion has a return-bend finger portion which slides axially on the speaker magnet as the speaker and grille assembly are inserted or removed. This sliding action occurs as the shoulder and arm portions are resiliently collapsed away from each other during passage of the clip arm portions through the panel opening providing a spring biased shock absorbing and vibration dampening installed engagement of the shoulder portions with the opening.

In addition to securely snapping the speaker and grille assembly into engagement with the panel opening, the clips provide a concealed but readily operable mounting arrangement. The clips also facilitate disengagement of the speaker and grille assembly from its associated panel so that the assembly may be removed and re-installed without damage to any parts.

Further objects and advantages of the present invention will be apparent from the following description, reference being made to the accompanying drawings wherein a preferred embodiment of the present invention is clearly shown.

DETAILED DESCRIPTION OF THE INVENTION

Figure 1:
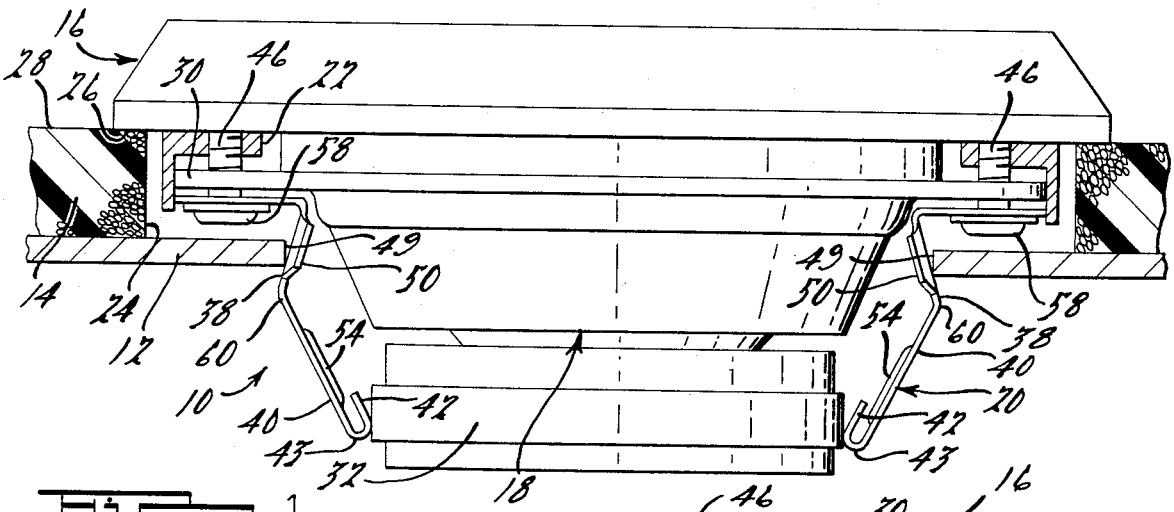
FIG. 1 is fragmentary side elevational view, partly in section, of the present circular speaker and grille assembly in position.

FIG. 1 of the drawings shows the present speaker and grille assembly 10 mounted to a vehicle base panel 12. In the disclosed embodiment the base panel has an overlying resilient instrument panel pad 14 of foamed rubber or plastic material. The speaker and grille assembly includes a speaker grille 16, a speaker 18 and a plurality of spring clips 20.

The grille 16 includes a pair of opposed right angled members 22 formed on the underside thereof. The numbers 22 are shown spaced inward from the grille periphery for reception in opening 24 of the pad 14 enablying the grille undersurface 26 to rest on the pad upper surface 28.

Figure 5:
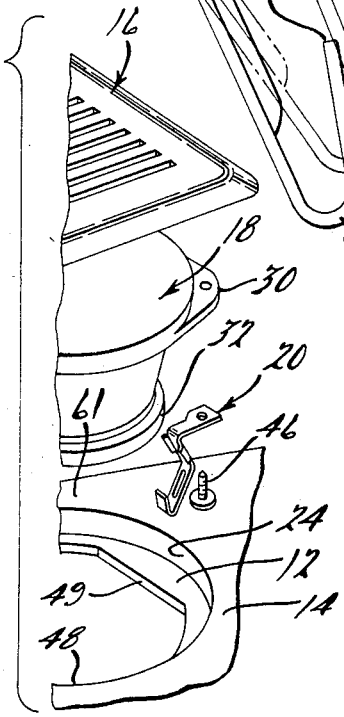
FIG. 5 is an exploded view of the speaker and grille assembly prior to installation in a vehicle instrument panel opening.

In FIGS. 1 and 5 the speaker 18 is shown with a pair of opposed mounting ears 30 extending laterally such that speaker ears 30 each nest within an associated grille members 22. The speaker has a lower cylindrical magnet portion 32 disposed concentrically with the speaker.

Figure 2:
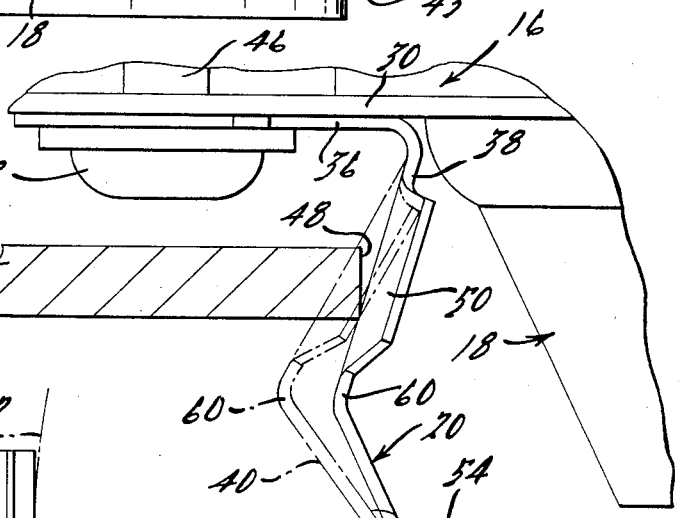
FIG. 2 is an enlarged fragmentary side elevational view, partly in section, of one spring clip in its installed position and showing the clip in phantom lines in its free state.
Figure 3:
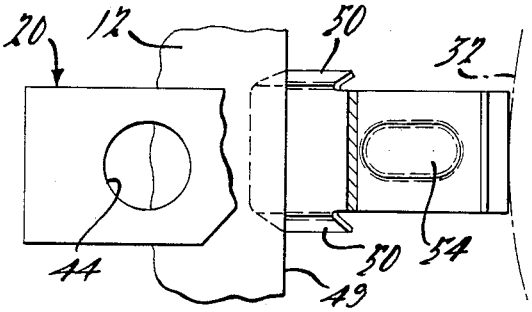
FIG. 3 is a detail top elevational view with parts broken away of one of the installed clips.
Figure 4:
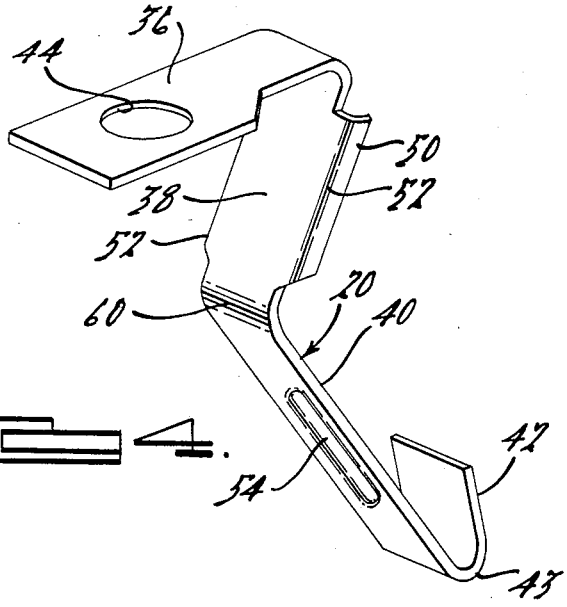
FIG. 4 is a perspective view of the clip of the present invention.

As best seen in FIGS. 2, 3 and 4, a plurality of spring clips 20, are provided to removably mount the grille and speaker assembly in the instrument panel 12. Each clip 20 has a generally Z-shaped section formed of resilient material, typically spring steel sheet metal. The clips are composed of an upper horizontally disposed mounting flange portion 36, a downwardly and outwardly diverging shoulder portion 38, a downwardly and inwardly converging arm portion 40 and a return bend finger portion 42 is formed at the free end of the arm portion. The finger portion 42 is joined to arm 40 by radiused bend 43.

The clip mounting flange 36 has an aperture 44 therein for receiving fastener means, such as the threaded screw fastener 46, which is secured to one of the grille members 22. The speaker 18 is sized to extend into a panel opening 48. As seen in FIG. 5 the opening 48 in the disclosed embodiment is irregularly shaped having a generally elongated or oval shape. The opening opposite ends have parallel linear side portions 49 adapted to engage one of the opposed clips 20.

It will be noted in FIGS. 3 and 4 that each edge of clip shoulder portion 38 is formed with a L-shaped wing 50. The free edges of the wings 50 are directed radially inwardly with respect to the panel opening 48. The wings 50 provide added stiffness to the shoulder portion 38 of the clip. Further, the radiused bends 52 of the wings are positioned to engage the lower edge of the panel opening 48 in a manner to be explained.

The arm portion 40 of the clip is formed with an elongated depression or embossed rib 54 to add rigidity to its spring rate. This insures that the clip finger portion 42 is maintained in spring biased line contact with the cylindrical magnet portion 32 of the speaker 18.

To mount the speaker and grille assembly an installer initially positions the speaker and grille assembly with the opposed clip arm portions 40 resting on the upper edges of the opening straight side portions 49. In this way the speaker is substantially aligned with the center of the opening 48. Upon the grille and speaker assembly being pushed downward the shoulder and arm portions are depressed radially inwardly and resiliently collapsed away from each other to permit passage of the clips 20 through the panel opening 48. The result is an axial sliding or camming of the clip finger portions 42 downwardly on the periphery of the cylindrical magnet 32.

Upon the grille undersurface 26 contacting the pad upper surface 28 the clip juncture 60 is established below the panel 12 with each clip shoulder 38 spring biased into contact with the lower edge of its associated linear side 49. Thus, the speaker and grille assembly are removably snapped into the vehicle instrument panel 12 providing a vibration and shock absorbing mount for the speaker.

It will be noted that the radiused edges 52 of the clip wings 50 engage the lower edge of the opening linear side portion 49. The wings 50 initially facilitate smooth, downward sliding movement between the clip shoulder and the panel side portions 49 during the snap-in clip engagement. Further, the wings 50 assist in any final lateral adjustment of the speaker and grille asembly. For example, it may be necessary to slide the grille 16 forward toward instrument panel moulding 61. The wings radiused edges 52 insure ready adjustment travel of the clips transversely along the linear sides 49 to the final position of the speaker and grille compensating for dimensional tolerances of the various body components.

Because of applicant's unique clip structure a spring dampened mounting is achieved. The speaker and grille assembly absorb shock forces by the clips resiliently deflecting both axially and laterally relative to the panel opening sides 49.

While the embodiment of the present invention as herein disclosed constitute a preferred form, it is to be understood that change and modifications might be adopted. Such changes and modifications are contemplated by the inventor, and he does not wish to be limited except to the scope of the approved claims.

I claim:

1. A mounting retainer assembly for vehicular cylindrical speaker and grille, comprising in combination; a generally cylindrical speaker adjustably and removably installed in a vehicle base panel elongated oval-shaped opening, said opening having parallel linear side portions, said speaker formed with lateral ear portions overlying the periphery of said panel opening, said speaker having a cylindrical magnet portion adjacent its lower end, a speaker grille mounted above said base panel and spaced a predetermined distance therefrom by an intermediate resilient pad, said pad provided with a similarly shaped opening of larger extent substantially paralleling the perimeter of said panel opening, a pair of diametrically opposed generally Z-shaped resilient spring clips, each said clip having a horizontally disposed mounting flange fixedly secured by a fastener to the underside of said grille, each said clip flange deformably joined at its inner end with a downwardly and outwardly diverging shoulder portion, said shoulder portion in its unflexed pre-installed mode forming an included acute angle with said flange, said shoulder portion in turn deformably joined at its lower end with a downwardly and inwardly converging arm portion forming an included obtuse angle with said shoulder portion, said arm portion terminating at its free end in a radiused inwardly directed return bend finger portion, an intermediate portion of each said clip shoulder portion having integral L-shaped wing portions extending laterally therefrom facilitating installation and removal of each said clip in said opening while providing increased spring stiffness thereof relative to its arm portion, each said shoulder and arm portion being resiliently collapsible inwardly away from each other permitting passage of each said clip shoulder and arm portions through said panel opening linear side portions during installation or removal of said speaker and grille assembly, each said installed clip shoulder portion resiliently contacting the bottom edge of its associated panel opening linear side portion while its associated finger portion is spring biased radially inwardly so as to resiliently engage said speaker magnet portion, each said clip shoulder portion adapted to be slid laterally on its associated panel opening linear side portion bottom edge, such that said speaker and grille assembly is adjustably movable laterally relative to said panel opening allowing ready tolerance adjustment of said assembly, wherein said resilient pad is compressed between said grille and said panel by said pair of clips, whereby each said finger portion operative for smooth axial sliding movement on said magnet portion providng a speaker and grille assembly vibration and shock dampening adjustable mounting.

2. The mounting assembly as defined in claim 1, wherein each said arm portion has an elongated depression to increase the stiffness of said arm portions.

* * * * *